US006003202A

United States Patent [19]

Dauterive

[11] Patent Number: 6,003,202

[45] Date of Patent: Dec. 21, 1999

[54] INSERTED LEG ADJUSTABLE CABINET HANDLE

[76] Inventor: LeRoy D. Dauterive, 2191 Emerson St., Terrytown, La. 70056

[21] Appl. No.: 08/958,612

[22] Filed: Oct. 27, 1997

Related U.S. Application Data

[63] Continuation-in-part of application No. 08/599,931, Feb. 12, 1996, abandoned.

[51] Int. Cl.[6] ..... A47B 95/02

[52] U.S. Cl. ..... 16/115; 16/125; 16/DIG. 41

[58] Field of Search ..... 16/124, 125, 126, 16/111 R, 110 R, 112, 114 R, 115, DIG. 40, DIG. 41

[56] References Cited

U.S. PATENT DOCUMENTS

| | | | |
|---|---|---|---|
| 1,552,856 | 9/1925 | Judge | 16/124 |
| 1,652,052 | 12/1927 | Rukenbrod | 16/125 |
| 1,655,744 | 1/1928 | Swanby | 16/114 |
| 2,672,103 | 3/1954 | Hohmes | 16/125 |
| 3,430,742 | 3/1969 | D'Elia et al. | 16/126 |
| 4,658,467 | 4/1987 | Stolarz | 16/126 |

FOREIGN PATENT DOCUMENTS

| | | | |
|---|---|---|---|
| 225971 | 12/1924 | United Kingdom | 16/125 |
| 239262 | 8/1925 | United Kingdom | 16/125 |

*Primary Examiner*—Chuck Y. Mah

*Attorney, Agent, or Firm*—Garvey, Smith, Nehrbass & Doody, L.L.C.

[57] ABSTRACT

An adjustable handle, fabricated of plastic and/or wood and/or metal and/or porcelain or other materials, facilitates the adjustment of the handle to align the ends of the handles with fastening screw holes set apart in various widths on cabinets, drawers, and doors. The adjustable handle increases the utility due to the incremental infinite adjustability of the width between the ends of the handle to align with fastening screw holes of various widths by means of a new engineering design. The adjustable handle is made of three pieces which are designed to slide together by means of the insertion of each of two of the pieces into a separate opposite side of the third piece of the handle, the third piece being hollowed out and minusculely tapered to snugly receive each one of the first mentioned two pieces.

6 Claims, 6 Drawing Sheets

INSERTED LEG ADJUSTABLE CABINET HANDLE

CROSS-REFERENCES TO RELATED APPLICATIONS

This is a continuation in-part of co-pending U.S. patent application Ser. No. 08/599,931, filed Feb. 12, 1996, now abandoned, which is incorporated herein by reference.

STATEMENT AS TO RIGHTS TO INVENTION MADE UNDER FEDERALLY-SPONSORED RESEARCH AND DEVELOPMENT

The invention was not created as a result of federally-sponsored research and development.

BACKGROUND OF INVENTION

Field of Invention.

The field of art of the invention is handle and pull devices found under PTO Class 16 Subclass 125.

The invention, hereinafter called "adjustable cabinet handle", relates to a significant improvement in the structure and design of cabinet, drawer, and door handles fabricated to facilitate the adjustment of the invented adjustable cabinet handle to align the ends of the invented adjustable cabinet handles with fastening screw holes set apart in various widths on cabinet, drawers, and doors.

The invented adjustable cabinet handle increases the utility of a cabinet handle so fabricated due to the incremental infinite adjustability of the width between the ends of the cabinet handle to align with fastening screw holes of various widths by means of a new, innovative, and unobvious use of existing materials and engineering design in a combination which does not presently exist.

Preliminary research of patents issued has identified the existence of the following prior art which applies to this invention.

Prior Art Patents

| Patent No. | Inventor(s) | Item | Issue Date |
|---|---|---|---|
| 1,832,409 | Mueller | Battery Carrier | November 1931 |
| 2,175,632 | Maga | Handle | October 1939 |
| 2,672,103 | Hohmes | Safety Crash Handle | March 1954 |
| 239,262 | Long | Handle | August 1925 |

The invention is specific to the above cited prior art. In the patent search for this application, no other prior art was identified which incorporated the specific improvements and engineering design specified herein to improve the above cited prior art.

Analysis of the invented structure and design of the prior art uncovered the following facts:

1. Although parts of the design of the invented adjustable cabinet handle have been in existence in the cited prior art for a great number of years, individuals expert and particularly knowledgeable in the field of cabinet, drawer, and door handle design, manufacturing, and sales have not produced or designed an adjustable handle of the design of the invented adjustable cabinet handle, therefore, it can be stated that the subject matter of this application is not obvious to a person of ordinary skill in the art if those individuals who are expert in the art have not conceived the adjustable cabinet handle apparatus described herein.

2. Each of the prior art handle designs have inherent deficiencies which are solved by the invented adjustable cabinet handle design. Specifically:

a. The handle structure and design shown in the above cited prior art of Maga does not provide the greater range of adjustment in width as is allowed by the invented adjustable cabinet handle due to the adjustment allowed by the Maga design being limited to the width of the socket blocks on the end of a ridged handle body thereby making handles fabricated following the Maga design less able to be aligned with fastening screw holes of various widths and therefore less useful and valuable than the invented adjustable cabinet handle.

The limited adjustment in the width of the handle ends in the Maga design renders the Maga design much less functional than the invented adjustable cabinet handle and therefore not as applicable or practical as the invented flexible cabinet handle for use as variable cabinet, drawer, and door handles.

b. The handle structure and design shown in the above cited prior art of Hohmes does not provide for the ridged fixing in place of the parts of the handle and requires more parts to accomplish adjustment of the handle than is provided for in the invented adjustable cabinet handle as the Hohmes design is focused on proving a vehicular safety handle which: a) can move and bend to fit various curves in vehicle mounting surfaces and b) can accommodate high stress automobile accident forces and therefore addressing these requirements results in the Hohmes design incorporating more parts than the invented adjustable cabinet handle to accomplish the adjustment and stress force accommodations.

This abundance of parts and lack of rigidity in the Hohmes design renders the Hohmes design less functional and more complicated to assemble and more costly to manufacture than the invented adjustable cabinet handle and therefore not as applicable or practical as the invented adjustable cabinet handle for use as variable cabinet, drawer, and door handles.

c. The handle structure and design shown in the above cited prior art of Mueller does not allow the Mueller handle to be adjusted in width to align with fastening screw holes of various widths as can be accomplished with the invented adjustable cabinet handle.

This lack of adjustability in width in the Mueller design renders the Mueller design non applicable to the variation in screw hole width problem solved by the invented adjustable cabinet handle and therefore not applicable to uses of the invented adjustable cabinet handle.

d. The handle structure and design shown in the above cited prior art of Long is not as operationally functional as the invented adjustable cabinet handle and requires more parts to accomplish adjustability and is limited in adjustability due to the limited adjustment increments possible due to the fixed widths of each and the total number of adjustment spacers used to spread the handle ends to various widths whereas the invented adjustable cabinet handles can be adjusted in an infinite incremental range to exactly align with the width of fastening screw holes.

The requirement of more parts and the limited adjustability in width in the Long design renders the Long design non applicable to the variation in the screw hole width problem solved by the invented adjustable cabinet handle and therefore not as functional or utilitarian as the invented adjustable cabinet handle.

SUMMARY OF THE INVENTION

Overview.

At present there is no standard width between fastening screw holes on the ends of cabinet and drawer handles manufactured and sold in the United States and internationally. Individual manufacturers make their handles to fit the specific hole widths suitable to their individual market. Individuals often have a difficult time in obtaining a handle of a design desired with a properly spaced width between fastening screw holes in handle ends.

In response to this need the subject adjustable cabinet handle has been invented to create cabinet, drawer, and door handles which can be adjusted to fit screw holes set apart by various widths.

The invented adjustable cabinet handle rather than prior art handle designs solves the problems of:

1. Manufacturers who are faced with the requirement of fabricating the same cabinet, drawer, and door handles with different widths between fastening screw holes to address purchaser requirements.

2. Sellers and distributors of cabinet, drawer, and door handles who must carry in inventory for sale the same cabinet, drawer, and door handle with different widths between fastening screw holes to address purchaser needs.

3. Purchasers of cabinet, drawer, etc. handles and pulls who are in need of cabinet, drawer, etc. handles and pulls in the decor the purchaser desires with the exact width between fastening screw holes required by the purchaser.

The invented adjustable cabinet handles can also to be fitted to fastening screw holes in the tops, sides, and/or bottoms of boxes, appliances, equipment, furniture, packaging, etc. wherever it is required that handles/pulls be attached to any of the aforesaid items using existing fastening screw holes.

Without the invented adjustable cabinet, drawer, and door handle design options available to the general public are limited to certain screw hole width sizes because the present non-adjustable handles do not fit all of the various fastening screw hole width sizes.

The invention is an adjustable cabinet door/drawer front/etc. handle/pull fabricated in two parts to facilitate the use of the said handle/pull in combination with cabinet doors/drawer fronts/etc. having handle/pull fastening screw holes set apart in various widths.

The invention is made of: one (1) Handle Body, plus two (2) Handle Legs, and two (2) Handle Attachment Screws. The invented adjustable cabinet handles can be fabricated of plastic and/or wood and/or metal and/or porcelain other such materials. The invented adjustable cabinet handles can be fabricated in various sizes to accomodate the intended use. For example, the invented adjustable cabinet handles could be sized to slidingly expand in width frp, and between one inch to one and one half inches for adjustment to align with common kitchen cabinet door or drawer attachment screw holes and from and between three inches and five inches for adjustment to align with large door attachment screw holes.

The invented adjustable cabinet handle design is based upon the concept of making cabinet handles with two or more moveable parts, male and female compatible, with the male component (i.e. the Handle Leg) sliding into and out of the female component (i.e. the Handle Body) for adjustment in width.

The invented adjustable cabinet handle can be modified in width to match exactly, existing screw holes in a cabinet door, drawer front, etc. by sliding the Handle Legs into the Handle Body to align screw holes drilled into the Handle Legs with the existing screw holes in a cabinet door, drawer front, etc., for the purpose of fastening the invented adjustable cabinet handle to a cabinet, drawer, door, etc. by inserting appropriately sized screws through the existing screw holes in a cabinet door, drawer front, etc. and thereafter threading the screws into the Handle Legs and turning the screws clockwise to fasten and tighten the invented adjustable cabinet handles to doors, drawers, etc.

The Handle Body of the invented adjustable cabinet handle can be fabricated with or without an inverted key slot. The inverted key slot shall be included if it becomes necessary to assure that the Handle Body will not turn on the Handle Legs.

If the Handle Body is fabricated with the inverted key slot, the Handle Legs will be fabricated with a matching key slot cavity to snugly fit the inverted key slot fabricated in the Handle Body.

DETAILED DESCRIPTION OF THE PREFERRED EMBODIMENTS

Reference Abbreviations and Numbers Used Herein

1 Handle Leg Without Inverted Key Slot Groove
2 Handle Body Without Inverted Key Slot
3 Metal Screw
4 Handle Body Core Cavity
5 Handle Leg With Inverted Key Slot Groove
6 Handle Body With Inverted Key Slot
7 Inverted Key Slot Groove
8 Protrusion of the Inverted Key Slot
9 Metal Screw Hole
10 Handle Body Without Handle Body Cavity
11 Handle Leg With Core Cavity
12 Combined Handle Body and Handle Leg Without Core Cavity
2A Handle Body—Straight With Triple Slots Design
2B Handle Body—Straight With Double Slots Design
2C Handle Body—Flowing Curves Without Slots Design
2D Handle Body—Flowing Curves With Slots Design
2E Handle Body—Straight Design
2F Handle Body—Curved Bead Design
2G Handle Body—Ridged Bead Design Views of the parts of one embodiment of the invented adjustable cabinet handle are shown on FIGS. 1A to 1E which are of a Handle Leg Without Inverted Key Slot Groove 1 which is cylindrical in shape and bent at or near 90 degrees and which has been fabricated without any grooves to be inserted into a properly sized Handle Body Without Inverted Key Slot 2 which has a smooth Handle Body Core Cavity 4; said Handle Body Core Cavity 4 being sized and minusculely tapered to receive snugly the insertion of the Handle Leg Without Inverted Key Slot Groove 1 to create a firm friction affixing of the Handle Body Without Inverted Key Slot 2 to the Handle Leg Without Inverted Key Slot Groove 1 with the affixed Handle Body Without Inverted Key Slot Groove and Handle Body Without Inverted Key Slot being fastened to cabinet door, drawer fronts, etc. by a properly sized Metal Screw 3 which is sized to be threaded into a Metal Screw Hole 9.

Figure 1C:
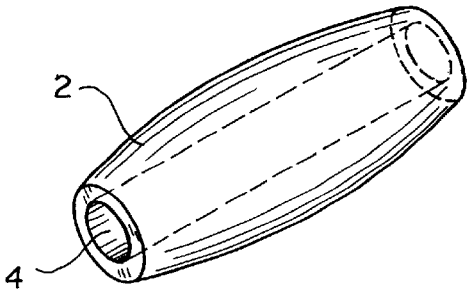
FIGS. 1A to 1E show the parts of one embodiment of the structure and engineering design of the invented adjustable cabinet handle which do not use an inverted Key Slot to aid in affixing the parts together.
Figure 1A:
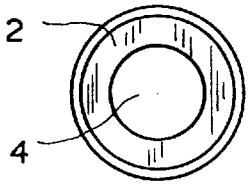

FIG. 1A shows the end view of a Handle Body Without Inverted Key Slot 2 which has a smooth Handle Body Core Cavity 4.

Figure 1B:
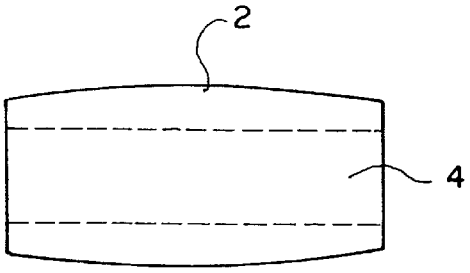

FIG. 1B shows a side view of a Handle Body Without Inverted Key Slot 2 which has a smooth Handle Body Core Cavity 4 through the center of the Handle Body Without Inverted Key Slot 2.

FIG. 1C shows a profile view of a Handle Body Without Inverted Key Slot 2 which has a smooth Handle Body Core Cavity 4 through the center of the Handle Body Without Inverted Key Slot 2.

Figure 1D:
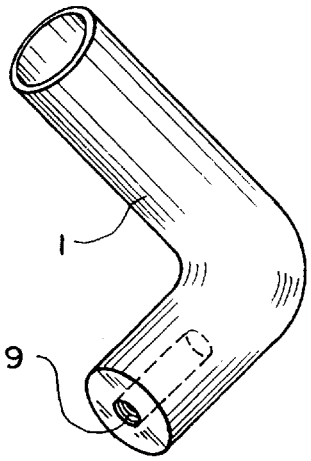

FIG. 1D shows a profile view of a Handle Leg Without Inverted Key Slot Groove 1 with a Metal Screw Hole 9.

Figure 1E:
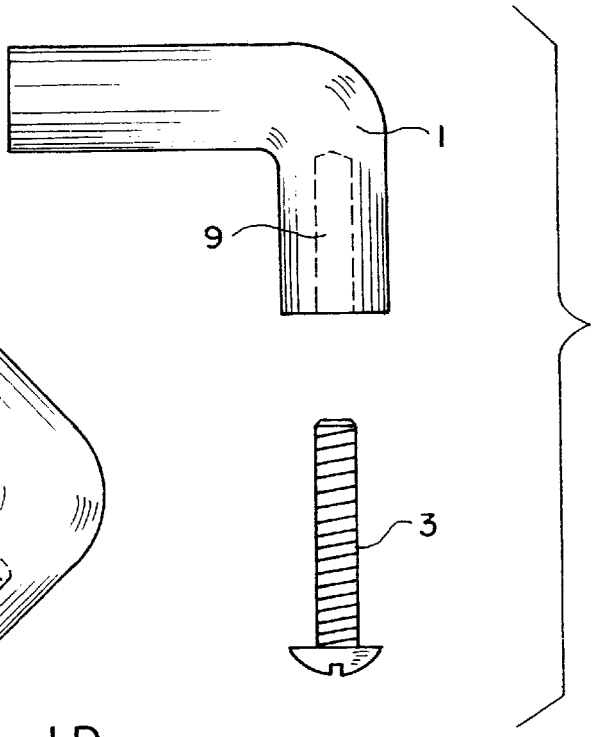

FIG. 1E shows a side view of a Handle Leg Without Inverted Key Slot Groove 1 with a Metal Screw Hole 9 and a Metal Screw 3.

Views of the parts of a second embodiment of the invented adjustable cabinet handle are shown on FIGS. 2A to 2F which are of a Handle Leg With Inverted Key Slot Groove 5 which is cylindrical in shape and bent at or near 90 degrees and which has been fabricated with an Inverted Key Slot Groove 7 to receive the Protrusion of the Inverted Key Slot 8 fabricated in the properly sized Handle Body With Inverted Key Slot 6; said Inverted Key Slot 7 protruding into the Handle Body Core Cavity 4 with said Handle Body Core Cavity 4 being sized and minusculely tapered to receive snugly the insertion of the Handle Leg With Inverted Key Slot Groove 5 to create a firm friction affixing of the Handle Body With Inverted Key Slot 6 to the Handle Leg With Inverted Key Slot Groove 5 with the matched Inverted Key Slot Groove and Inverted Key Slot preventing the turning of the Handle Body With Inverted Key Slot 6 around the Handle Leg With Inverted Key Slot Groove 5 with the affixed Handle Body With Inverted Key Slot Groove and Handle Body With Inverted Key Slot being fastened to cabinet door, drawer fronts, etc. by a properly sized Metal Screw 3 which is sized to be threaded into a Metal Screw Hole 9.

Figure 2A:
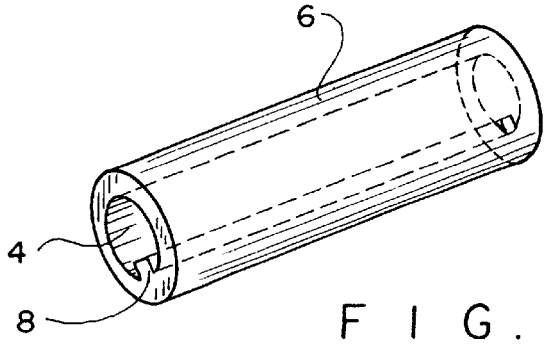
FIGS. 2A to 2F show the parts of a second embodiment of the structure and engineering design of the invented adjustable cabinet handle which uses an Inverted Key Slot to aid in affixing the parts together.

FIG. 2A shows a profile view of a Handle Body With Inverted Key Slot 6 with the Protrusion of the Inverted Key Slot 8 inside of the Handle Body Core Cavity 4.

Figure 2B:
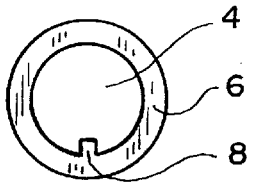

FIG. 2B shows an end view of a Handle Body With Inverted Key Slot 6 with the Protrusion of the Inverted Key Slot 8 in the inside center of the Handle Body Core Cavity 4.

Figure 2C:
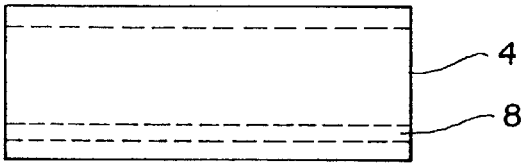

FIG. 2C shows a side view of a Handle Body With Inverted Key Slot 6 with the Protrusion of the Inverted Key Slot 8 through the inside center of the Handle Body Core Cavity 4.

Figure 2D:
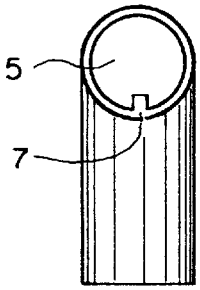

FIG. 2D shows an end view of a Handle Leg With Inverted Key Slot Groove 5 with an Inverted Key Slot Groove 7.

Figure 2F:
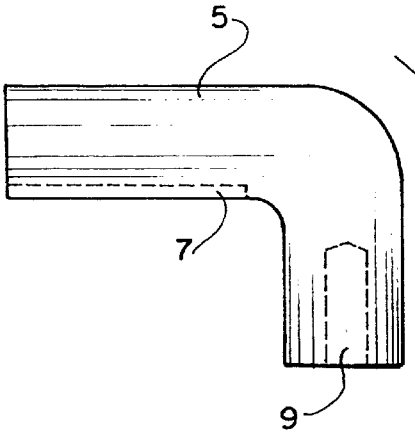
Figure 2F:
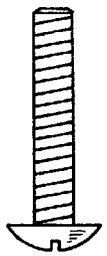
Figure 2E:
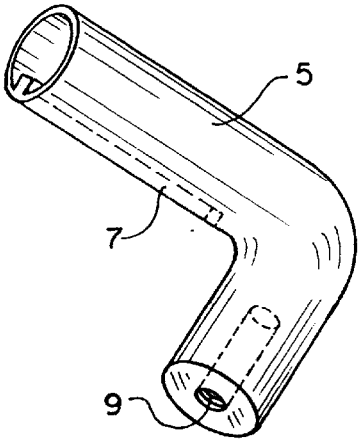

FIG. 2E shows a profile view of a Handle Leg With Inverted Key Slot Groove 5 with an Inverted Key Slot Groove 7 and a Metal Screw Hole 9.

FIG. 2F shows a side view of a Handle Leg With Inverted Key Slot Groove 5 with an Inverted Key Slot Groove 7 with a Metal Screw Hole 9 and a Metal Screw 3.

Figure 6A:
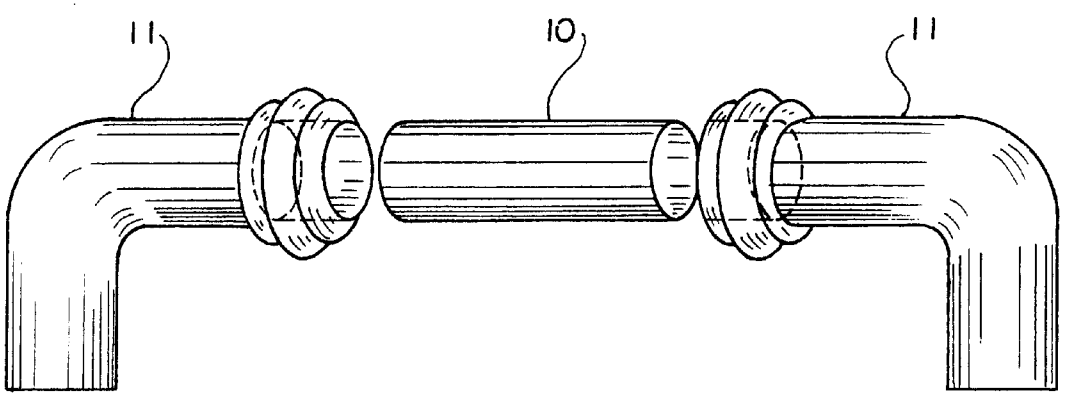
FIGS. 6A and 6B show some of the different embodiments of the invented adjustable cabinet handle fabricated in two and three pieces.

FIG. 6A shows a profile view of a three part adjustable cabinet handle where the Handle Body Without Handle Body Cavity 10 is to be inserted into the Handle Leg With Core Cavity 11.

Figure 6B:
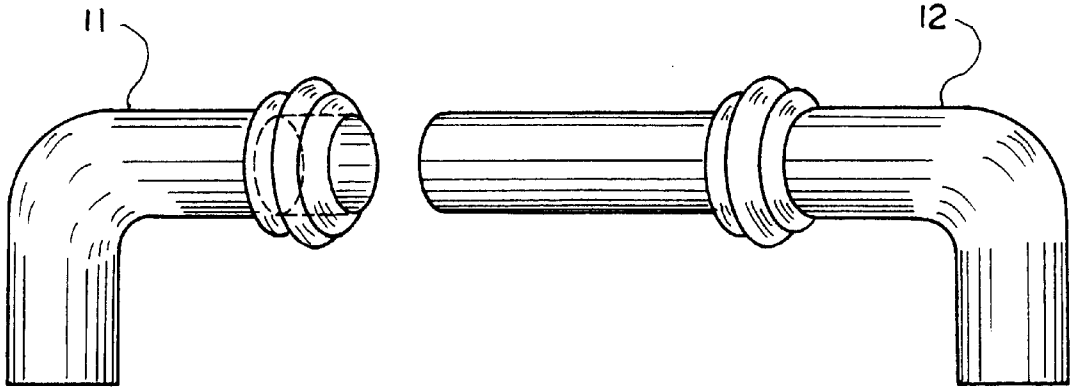

FIG. 6B shows a profile view of a two part adjustable cabinet handle where the Combined Handle Body and Handle Leg Without Core Cavity 12 is to be inserted into the Handle Leg With Core Cavity 11.

Figure 3:
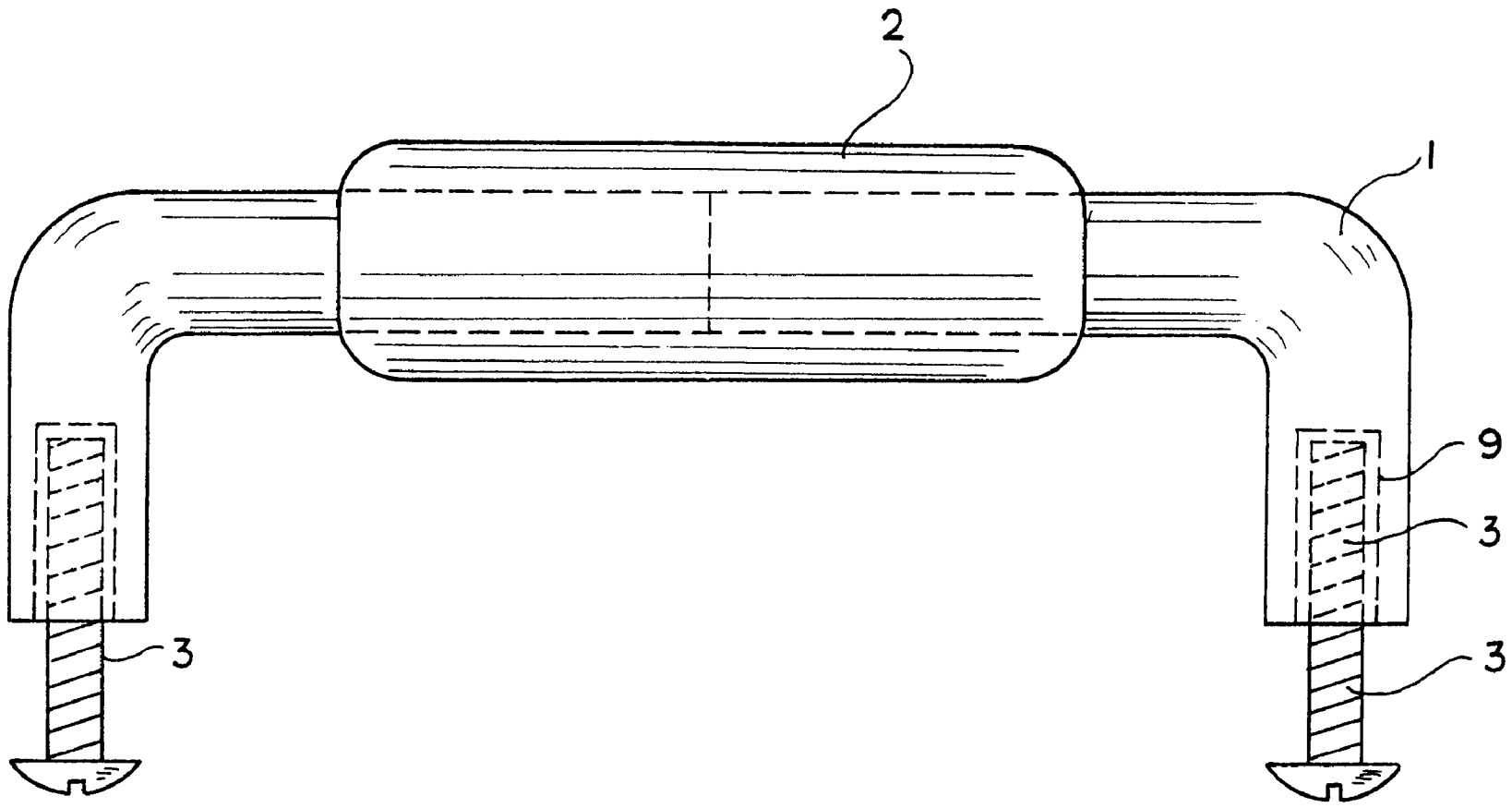
FIG. 3 shows the invented adjustable cabinet handles assembled without the use of the Inverted Key Slot.

The assembled parts of one embodiment of the invented adjustable cabinet handle are shown on FIG. 3 where each of two Handle Leg Without Inverted Key Slot Groove 1 which are both cylindrical in shape and bent at or near 90 degrees and have been fabricated without any grooves, are inserted into the Handle Body Cavity opening on each end of a properly sized Handle Body Without Inverted Key Slot 2 which has a smooth Handle Body Core Cavity; said Handle Body Core Cavity being sized and minusculely tapered to receive snugly the insertion of each Handle Leg Without Inverted Key Slot Groove 1 to create a firm friction affixing of the Handle Body Without Inverted Key Slot 2 to each Handle Leg Without Inverted Key Slot Groove 1 with the affixed Handle Body Without Inverted Key Slot Groove and Handle Body Without Inverted Key Slot being fastened to cabinet door, drawer fronts, etc. by a properly sized Metal Screw 3 which is sized to be threaded into a Metal Screw Hole 9.

Figure 4:
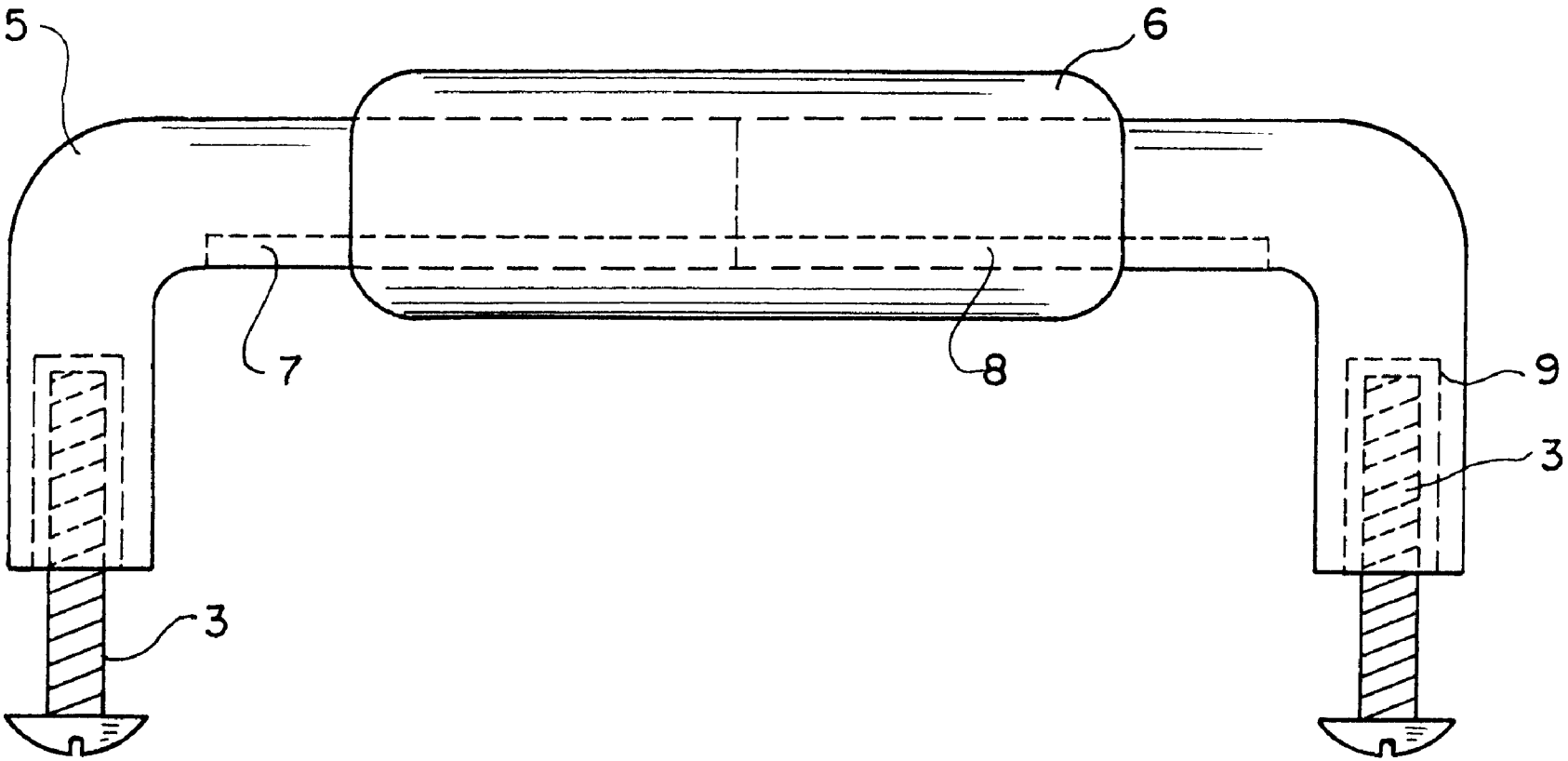
FIG. 4 shows the invented adjustable cabinet handles assembled with the use of the Inverted Key Slot.

The assembled parts of a second embodiment of the invented adjustable cabinet handle are shown on FIG. 4 where each of two Handle Leg With Inverted Key Slot Groove 5 which are both cylindrical in shape and bent at or near 90 degrees and which have been fabricated with an Inverted Key Slot Groove 7 to receive the Protrusion of the Inverted Key Slot 8 fabricated in the properly sized Handle Body With Inverted Key Slot 6, are inserted into the Handle Body Cavity opening on each end of a properly sized Handle Body With Inverted Key Slot 2 which has a smooth Handle Body Core Cavity; said Inverted Key Slot 7 protruding into the Handle Body Core Cavity with said Handle Body Core Cavity being sized and minusculely tapered to receive snugly the insertion of the Handle Leg With Inverted Key Slot Groove 5 to create a firm friction affixing of the Handle Body With Inverted Key Slot 6 to the Handle Leg With Inverted Key Slot Groove 5 with the matched Inverted Key Slot Groove and Inverted Key Slot preventing the turning of the Handle Body With Inverted Key Slot 6 around the Handle Leg With Inverted Key Slot Groove 5 with the affixed Handle Body With Inverted Key Slot Groove and Handle Body With Inverted Key Slot being fastened to cabinet door, drawer fronts, etc. by properly sized Metal Screws 3 which are sized to be threaded into the Metal Screw Holes 9.

Figure 5A:
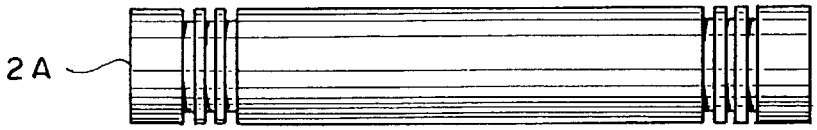
FIGS. 5A to 5G show some of the different possible designs of the Handle Body of the invented adjustable cabinet handle.
Figure 5B:
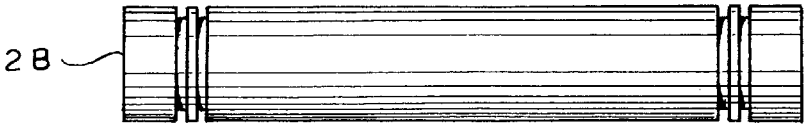
Figure 5C:
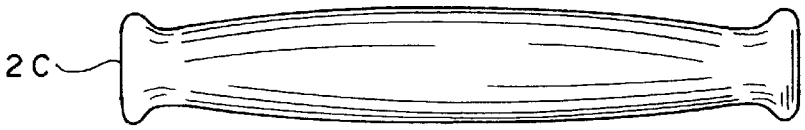
Figure 5D:
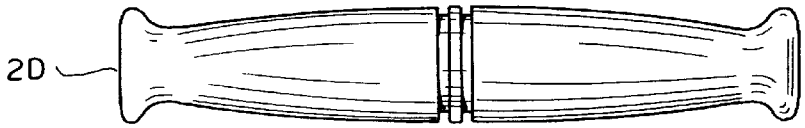
Figure 5E:
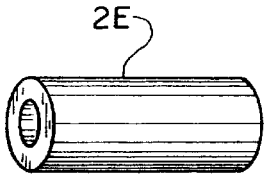
Figure 5F:
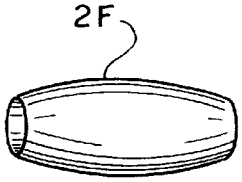
Figure 5G:
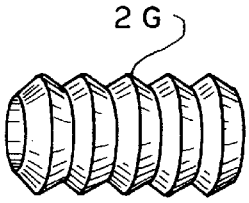

Examples of some of the different designs and shapes in which both the Handle Body Without Inverted Key Slot and the Handle Body With Inverted Key Slot may be fabricated for are shown on FIGS. 5A to 5B.

The preferred embodiment of the invented adjustable cabinet handle is a cabinet, drawer, door, etc. handle made of three pieces (e.g. 1, 2, 1 or 5, 6, 5) which are designed to slide together by means of the insertion of each of two of the pieces (1 or 5) into a separate opposite side of the third piece (2, 6, 2A, 2B, 2C, 2D, 2E, 2F, 2G, etc.) of the handle, said third piece being hollowed out and minusculely tapered to snugly receive each one of the first mentioned two pieces (1 or 5).

Further, the preferred embodiment of the invented adjustable cabinet handle is a cabinet, drawer, door, etc. handle which is made of pieces which are sized to slide into and out of each other for the purpose of alignment of the screw holes in the handle designed to receive attaching screws with any existing screw holes in a cabinet or drawer which were created to accept handle attaching screws thereby allowing existing cabinet or drawer handle attachment screw holes to be used to attach the handle with proper alignment of the holes in the handle for attaching screws with any variance in the spacing between the screw holes in an existing cabinet or drawer created to accept handle attaching screws.

The preferred embodiment of the invented adjustable cabinet handle is a cabinet, drawer, or door handle which is composed of:

a. Two (2) handle pieces (i.e. the outer handle pieces) which may or may not be identically shaped and sized and are generally cylindrical in shape but may be modified in shape for aesthetic reasons, each outer handle piece being bent at or close to a 90 degree angle the same short distance from one end of each outer handle piece to form the outer handle pieces into an "L" shape and sized to fit snugly with and without an underside slot when the end of each outer handle piece is inserted to some depth into an existing hole going part of the way into or all of the way through the center of or off of the center of a third handle piece (i.e. the coupling handle piece) used to connect the outer handle pieces to form the handle, and b. One (1) handle piece (i.e. the coupling handle piece) which is generally cylindrical in shape but which may be modified in shape for aesthetic design reasons said coupling handle piece having a hole part of the way into or all of the way through the center or off center through the coupling handle piece, said hole having a protruding ridge inside and at the bottom of said hole if the outer handle pieces have matching underside slots with said hole being sized to receive snugly at various depths of insertion the ends of the outer handle pieces when said ends are inserted at various depths into the existing hole going part of the way into or all of the way through the center of or off of the center of the coupling handle piece.

The foregoing embodiments are presented by way of example only; the scope of the present invention is to be limited only by the following claims.

What is claimed by the inventor as being a new, innovative, and unobvious use and desired to be protected by Letters Patent of the United States is as follows:

1. An adjustable-length handle apparatus for cabinets, drawers, doors, and other items comprising:

(a) a handle body having a cavity therein, the cavity having a longitudinal axis;

(b) a pair of handle legs, each handle leg including means for attachment to a door or a drawer or other item and a projection sized to be received in the cavity of the handle body, the projections of the handle legs being smooth and being slidingly received in the cavity of the handle body along the longitudinal axis of the cavity; and (c) means for preventing rotation of the handle body about the longitudinal axis of the cavity, wherein:

the handle body includes a protrusion inwardly projecting into the cavity of the handle body, and the projections of the handle legs include a slot sized to fit snugly the handle body protrusion; and the protrusion and slot are part of the means for preventing rotation.

2. The handle apparatus of claim 1, wherein the slot extends longitudinally.

3. An adjustable-length handle apparatus for cabinets, drawers, doors, and other items comprising:

(a) a handle body having a cavity therein, the cavity having a longitudinal axis;

(b) a pair of handle legs, each handle leg including means for attachment to a door or a drawer or other item and at least one handle leg having a projection sized to be received in the cavity of the handle body, the projection being smooth and being slidingly received in the cavity of the handle body along the longitudinal axis of the cavity; and (c) means for preventing rotation of the handle body about the longitudinal axis of the cavity, wherein:

the handle body includes a protrusion inwardly projecting into the cavity of the handle body; and the projection includes a slot sized to fit snugly the handle body protrusion; and the protrusion and slot are part of the means for preventing rotation.

4. The handle apparatus of claim 3, wherein the slot extends longitudinally.

5. An adjustable-length handle apparatus for cabinets, drawers, doors, and other items comprising:

(a) a handle body having a longitudinal axis;

(b) a pair of handle legs, each handle leg including means for attachment to a door or a drawer or other item;

(c) means for allowing the handle body and at least one handle leg to slide relative to one another alone the longitudinal axis of the handle body including corresponding mating portions on the handle body and the handle leg, wherein the mating portions include:

a cavity in the handle body, the cavity having a longitudinal axis; and a projection in at least one handle leg, the projection being sized to be received in the cavity of the handle body, the projection being smooth and being slidingly received in the cavity of the handle body along the longitudinal axis of the cavity; and (d) means for preventing rotation of the handle body about the longitudinal axis of the handle body, wherein:

the handle body includes a protrusion inwardly projecting into the cavity of the handle body, and the projection includes a slot sized to fit snugly the handle body protrusion; and the protrusion and slot are part of the means for preventing rotation.

6. The handle apparatus of claim 5, wherein the slot extends longitudinally.

* * * * *